US005197102A

United States Patent [19]

Sondermeyer

[11] Patent Number: 5,197,102

[45] Date of Patent: Mar. 23, 1993

[54] AUDIO POWER AMPLIFIER SYSTEM WITH FREQUENCY SELECTIVE DAMPING FACTOR CONTROLS

[75] Inventor: Jack C. Sondermeyer, Meridian, Miss.

[73] Assignee: Peavey Electronics Corporation, Meridian, Miss.

[21] Appl. No.: 641,731

[22] Filed: Jan. 14, 1991

[51] Int. Cl.[5] ..... H04R 3/00

[52] U.S. Cl. ..... 381/96; 381/98; 381/59; 330/294; 330/109

[58] Field of Search ..... 381/96, 98, 59; 330/294, 107, 109

[56] References Cited

U.S. PATENT DOCUMENTS

| | | | |
|---|---|---|---|
| 3,753,140 | 8/1973 | Feistel . | |
| 3,784,924 | 1/1974 | Mansnerus . | |
| 3,831,103 | 8/1974 | Ruegg et al. . | |
| 3,946,328 | 3/1976 | Boctor . | |
| 4,002,994 | 1/1977 | Fender . | |
| 4,012,704 | 3/1977 | Rollett . | |
| 4,034,308 | 7/1977 | Wermuth et al. . | |
| 4,092,494 | 5/1978 | Micheron . | |
| 4,099,134 | 7/1978 | Schroder . | |
| 4,107,622 | 8/1978 | Toyomaki . | |
| 4,151,477 | 4/1979 | Yokoyama . | |
| 4,220,817 | 9/1980 | Kampmann . | |
| 4,223,273 | 9/1980 | Yokoyama . | |
| 4,229,619 | 10/1980 | Takahashi et al. . | |
| 4,236,118 | 11/1980 | Turner . | |
| 4,260,954 | 4/1981 | Crooks . | |
| 4,290,335 | 9/1981 | Sondermeyer . | |
| 4,393,353 | 7/1983 | Minaegawa | 330/294 |
| 4,400,583 | 8/1983 | Bloy | 381/98 |
| 4,528,515 | 7/1985 | Gross . | |
| 4,633,189 | 12/1986 | Kawakami et al. | 330/294 |

*Primary Examiner*—Jin F. Ng
*Assistant Examiner*—Nina Tong
*Attorney, Agent, or Firm*—Watson, Cole, Grindle & Watson

[57] ABSTRACT

In a particular embodiment, an audio amplifier drives a load in the form of a sound producing loud speaker exhibiting a frequency variable impedance characteristic over a range of audio frequencies. Voltage and current feedback circuits respectively establish a minimum voltage feedback and a feedback characteristic representative of the load. A presence feedback circuit couples the voltage feedback circuit to ground for reducing feedback with increasing frequency above a selected level whereby the damping factor of the amplifier is reduced. A resonance feedback circuit coupled in parallel with the voltage feedback circuit reduces voltage feedback with decreasing frequencies below the selected level whereby the damping factor is accordingly reduced. The amplifier is responsive to the reduced damping factor for increasing power to the load for enhancing the sound produced by the loud speaker.

16 Claims, 4 Drawing Sheets

AUDIO POWER AMPLIFIER SYSTEM WITH FREQUENCY SELECTIVE DAMPING FACTOR CONTROLS

BACKGROUND OF THE INVENTION:

The invention relates to musical instrument audio power amplifiers for driving loud speakers. In particular, the invention relates to audio amplifiers for guitars and other musical instruments having frequency selective damping factor controls for improving the sound emitted by loud speakers over a full range of audio inputs and particularly at low frequencies near system resonance.

The damping factor of a power amplifier is sensitive to load impedance. Although loud speakers usually have a nominal impedance, the actual impedance varies considerably over its range of operating frequencies. In particular, the impedance of a loud speaker increases with increasing frequency due to the inductance of the loud speaker coil. At low frequencies the impedance of a loud speaker increases generally to a maximum at free air resonance which is the function of the mechanical characteristics of the speaker and its enclosure. When mounted in an enclosure the impedance peaks at the so called system resonance which is a function of the speaker and enclosure characteristics. It is common practice to select speakers and enclosures to obtain a desired sound. It is not entirely clear what effect damping factor has on the sound quality of a loud speaker, because that is subjective. However, there is general agreement that a change in the damping factor can significantly affect the volume of loud speaker sound.

Generally, the damping factor of a power amplifier is defined as the ratio of the load impedance to the output impedance of the amplifier.

$$DF = \frac{Z_L}{Z_O}$$

where $Z_L$ is the load impedance and $Z_O$ is the amplifier output impedance.

It is also generally accepted that the damping factor may be defined in terms of full load voltage and no load voltage as follows:

$$DF = \frac{V_{rms}(FL)}{V_{rms}(NL) - V_{rms}(FL)}$$

where $V_{rms}$ (FL) is the amplifier output in rms at full load and $V_{rms}$ (NL) is the amplifier output voltage in rms at no load or open circuit.

When damping factor is defined in terms of the impedance, an amplifier with a high damping factor is viewed as having a low output impedance. Such an amplifier has particular use in high fidelity applications in which the speaker produces a generally flat frequency response. This is generally referred to as a so called "tight" or "controlled" sound because the speaker cone has controlled or limited motion.

An amplifier with a low damping factor is viewed as having a high output impedance. Such an amplifier has less control over the loud speaker and thus the cone motion is not as controlled. For most guitar or instrument applications, amplifiers having relatively low damping factors are desirable because they are believed to make the guitar sound better to the musician and audience alike. The low damping factor improves both the high and low frequency response and causes the associated enclosure to produce more low end output at or near the enclosure resonance. The sound produced by speakers driven by a low damping factor amplifier are said to "flop" or "overshoot" and the low end sound is "boomy". In any event, sound quality is subjective to the listener. All that can be said is that a boomy sound is commercially desirable for guitar amplifier applications.

When the damping factor is examined in terms of its voltage relationships it is thought that a lower damping factor can advantageously affect the high and low frequency response of a loud speaker by increasing the power delivered to the speaker as the impedance increases. For example, using the voltage relationship referred to above, an amplifier having a damping factor of one (1) and producing a full load output voltage of 20 volts at the mid band frequencies can produce 40 volts at no load. In other words, if the output of the amplifier is open circuit, the output is 40 volts. Similarly, it can be shown that an amplifier with a damping factor of 100 and delivering 20 volts at full load produces about 20.2 volts at no load. Thus, a high damping factor amplifier has a relatively constant output voltage as the impedance of the speaker increases. Unfortunately, as explained below, the power delivered on the speaker from an amplifier with a high damping factor is reduced at both high and low frequencies which results in a weak or poor sound for guitar applications.

Power is a function of the output voltage and may be defined as: $P = V_{rms}^2/Z_L$. As the load impedance increases the actual power delivered to the load decreases. Further, as the output voltage increases the power delivered to the load increases by the square of the voltage. In the above example, if the damping factor is high there is a significant reduction in output power because the output voltage does not increase in proportion to the increase in speaker impedance. If the damping factor is low, the power delivered to the load is not reduced as much because the output voltage increases to a greater extent with increasing speaker impedance, and the speaker sound is thereby enhanced.

Damping factors less than 1 for example, 0.25 or less are not uncommon. However, simple and effective control of the damping factor values particularly over the low frequency range has not been achieved. There are controls, sometimes referred to as presence controls, which provide boost to the amplifier output at high frequencies and add so called "brilliance" or "edge" to the amplifier which cannot be duplicated with conventional high end equalization or boost or treble circuitry.

Presence control in the form of a potentiometer (pot) and parallel capacitor coupled to the wiper of the pot in the cathode circuit of a tube amplifier is known. The presence control improves high end performance by lowering the damping factor. There is also a known so called global damping control for tube amplifiers which inserts a high resistance in series with the feedback resistor from the load. In such an arrangement the increased impedance in the feedback circuit decreases the damping factor of the amplifier without regard to frequency. Although it is desired to enhance the low frequency or "bottom" using this control, functionally the global damping control does not achieve satisfactory results for two reasons. First, the range of the control has been limited. Second, the damping control adversely affects the high end settings. Presence controls and variable global damping have not been used in solid state amplifiers because they interfere with the necessary feed back circuits.

Tube type amplifiers normally have a characteristic low damping factor resulting from an inherently low feedback requirements. Thus, further reduction of feedback to thereby reduce the damping factor is achieved by reducing the elementary feedback. However, tubes as amplifier components although effective and in many cases preferable, are being used less. This is so mainly because solid state devices have virtually supplanted most applications for tubes and thus there has been a general reduction in demand for tubes and tube manufacturing capability world wide. In effect tubes are obsolete for many applications and are becoming difficult to obtain for remaining applications where they are thought to be superior.

Solid state amplifiers have a characteristically high damping factor resulting from required high feed back requirements. This characteristic makes it difficult to reduce the damping factor without adversely affecting the feedback circuitry. However, because of the reduced availability of tubes, a low damping factor solid state amplifier is needed.

SUMMARY OF THE INVENTION

The present invention provides independently variable frequency selective damping factor controls especially for guitar amplifiers which incorporate the frequency dependent speaker load into the control loop. The invention is applicable to all types of audio power amplifiers but is particularly useful in solid state audio power amplifiers which sometimes suffer from the inability to produce the necessary strong high and low outputs useful for effectively driving loud speakers in guitar applications.

In accordance with the invention, the output impedance of the amplifier is reduced or adjusted in order to decrease the damping factor.

In accordance with a particular embodiment of the present invention, the response of a loud speaker with which it is employed is greatly enhanced regardless of speaker type and quality. The loud speaker is an electromechanical system having a mechanical resonance point which depends upon the mechanical characteristics of the enclosure and the electrical characteristics of the speaker which cause an increase in the impedance with changing frequency. At low frequency the impedance changes sharply and peaks at the system resonance due to electrical and mechanical speaker characteristics. At high frequency the impedance change is primarily electrically dependant. The invention improves the sound emitted by the loud speaker when the speaker impedance increases with a change in frequency about a nominal mid range value. The technique is superior to those which simply provide low and high frequency equalization.

In a specific embodiment, the invention comprise independently variable a solid state audio power amplifier having an input, an output and independently variable frequency selective damping factor controls. The amplifier drives a load in a form of a sound producing loud speaker which has a variable impedance characteristic in the audio frequency range. A voltage limit feedback circuit is coupled between the input and output of the amplifier for establishing a minimum level of voltage feedback as at all times. A load current feedback circuit is coupled between the load and the input for establishing a feedback characteristic representative of the load. A presence feedback circuit coupled in parallel with the voltage feedback circuit reduces feedback with increasing frequency above a selected level whereby the damping factor of the amplifier is reduced. A resonance feedback circuit coupled in series with the voltage feedback circuit reduces voltage feedback with decreasing frequencies below a selected level whereby the damping factor is accordingly reduced. The presence and resonance feedback circuits operate independently without interference, so that speaker performance is enhanced at the low and high ends without compromising one or the other. In particular, the amplifier is responsive to reduce the damping factor and to thereby variably and selectively increase the power to the load for enhancing the sound produced by the loud speaker at both high and low frequencies.

DESCRIPTION OF THE INVENTION

Figure 1:
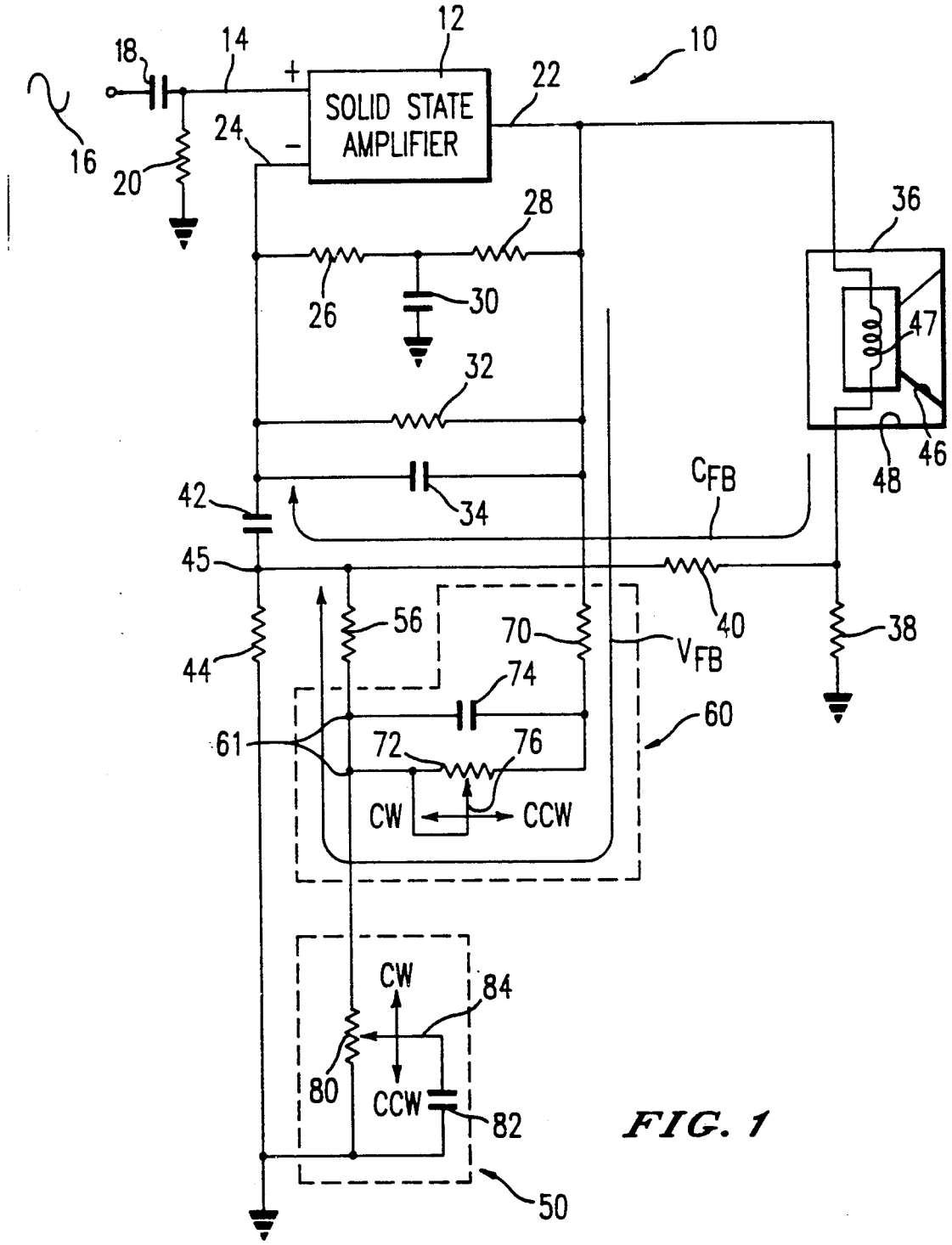
FIG. 1 is a schematic diagram illustrating a solid state amplifier employing frequency selective damping factor controls according to the present invention.

FIG. 1 illustrates an audio power amplifier system 10 having frequency selective damping factor controls according to the present invention. The amplifier 10 includes a solid state amplifier 12 having one or more stages (not shown) and having a noninverting or positive input 14 for receiving a variable frequency audio signal 16, such as a guitar input, through input capacitor 18. Input resistor 20 is coupled to the junction between the input 14 and the capacitor 18 for establishing a ground reference for the input signal.

The amplifier 12 has an output lead 22 and an inverting or negative input 24. A dc feedback path is establish by a pair of series connected feedback resistors 26 and 28 coupled between the output 22 and the inverting input 24. A coupling capacitor 30 connected between the resistors 26 and 28 defeats AC feedback to the input over the loop. The resistors 26 and 28 provide overall DC feedback for the amplifier 10.

AC feedback resistor 32 is coupled between the output 22 and the inverting input 24 in parallel with the DC feedback resistors 26 and 28. A feedback capacitor 34 in shunt with the feedback resistor 32 provides circuit stability. The feedback resistor 32 has a relatively large value for providing at all times a minimum AC feedback to the amplifier input 24 in order to prevent an unacceptably high gain at low feedback levels.

A load impedance 36 is coupled to the output 22 of the amplifier 12, and a sampling resistor 38 is serially connected between the load impedance 36 and ground as shown. Current feedback resistor 40 is coupled to the node between load impedance 36 and the sampling resistor 38. The sampling resistor 38 is small compared to the load impedance 36 and provides a small voltage at the node therebetween which is fed back to the inverting input 24 of the amplifier through the current feedback resistor 40. An AC isolating capacitor 42 is serially connected between the current feedback resistor 40 and the inverting input 24 to block dc feedback.

A gain resistor 44 is connected between node 45 and ground to establish the amplifier gain characteristic in combination with the various feedback impedances which feed node 45. The value of the various resistances are selected to establish a nominal overall gain and feedback for the op-amp 12.

The load impedance is represented by a speaker 46 having an inductive reactance represented by coil 47. The speaker 46 is located in an enclosure 48 which has a mechanical resonance which affects the speaker impedance. The speaker 46 and enclosure 48 may have different resonance points. Typically, however, the resonance points are preferably matched.

Feedback may be modified in two ways. First, current feedback may reduced by eliminating current feedback provided by the sampling resistor 38. This accomplishment by increasing the loud speaker impedance by means of a variable series resistance (not shown) or by simply open circuiting the loud speaker circuit. Second, voltage feedback between the output 22 and the input 24 may be decreased by adding impedance to the AC feedback path.

In accordance with the present invention, the amplifier 10 includes respective independently variably frequency selective respective presence and resonance damping factor controls hereinafter referred to as presence control 50 and resonance control 60. As used herein the term presence generally refers to the rising impedance in the speaker associated with high frequency operation which is primarily an inductance dependent characteristic. Likewise as used herein the term resonance generally refers to the sharply rising impedance in the form of a peak or knee which occurs at low frequency and which is primarily dependent on electromechanical characteristics of the speaker and its enclosure. The controls 50 and 60 are in the form of alternate feedback paths that are separately adjustable to reduce voltage feed back to thereby lower the damping factor of the amplifier 10 which results in an increased output voltage of the amplifier 12 in the respective high and low ends. Power delivered to the load 36 is thus increased and the speakers produce more sound. The presence and resonance controls 50 and 60 are commonly coupled at node 61 via a series dividing resistor 56 to the negative input 24.

The resonance control 60 includes a relatively small feedback resistor 70 in series with parallel combination of resonance potentiometer 72 and resonance capacitor 74. The presence control 50 includes the parallel combination of presence pot 80 and capacitor 82 coupled to the wiper 84. The presence control 50 is connected between node 45 and ground.

For the output load 36 connected as shown, there are now two operating variable feedback paths $C_{FB}$ and $V_{FB}$ in the amplifier 10. The first feedback path $C_{FB}$ is from the voltage developed across the sampling resistor 38 which is a voltage proportional to the current through the load impedance 36. $C_{FB}$ is fed back through the current feedback resistor 40 to the negative input 24. $C_{FB}$ is a function of the speaker characteristic impedance only.

The second feedback path $V_{FB}$ extends from the output 22 to the inverted input 24 via divider resistor 56 through resistor 70 and resonance control 60. The combination of both feedback paths $C_{FB}$ and $V_{FB}$ together with the gain resistor 44 determines the full load output voltage of the amplifier 10 or the amplifier gain. If the output impedance 36 is removed from the circuit, the feedback path $C_{FB}$ through the resistor 40 is eliminated and the output voltage increases to a new value called the no load value.

The presence control 50 operates as follows: when the pot 80 is set to the full counterclockwise (CWW) position, illustrated by the arrow, the capacitor 82 is grounded and offers nothing to the circuitry. That is, the resistance of pot 80 is not shunted by the impedance of capacitor 82. Thus, feedback from the output 12 which is divided at node 61 is applied to the input 24. However, when the pot 80 is set to the full clockwise (CW) setting, the capacitor 82 is connected to the voltage feedback path $V_{FB}$ and thereby reduces voltage feedback at high frequencies by effectively grounding node 61 and thereby reducing the damping factor at those frequencies. Various settings of the pot 80 control offer various amounts of damping factor reduction. Thus, adjustment of the pot 80 results in a reduction on the damping factor to provide high frequency power to the load 36 or loud speaker and thus the guitar player gets a pleasing edge type sound.

The resonance control 60 operates as follows: when the pot 72 in series with the resonance feedback resistor 70 is set full counterclockwise (CCW) as shown by the arrow, its resistance value is zero and therefore offers nothing to the circuit. That is, the resistance of the feedback path through resistor 70 is low compared to the resistance through resistor 32. When, however, the pot 72 is set to the full clockwise position, it adds a large value of resistance in series with resistor 70. For example, the pot 72 has a variable 1M ohm in series with the feedback resistor 70. This additional resistance greatly reduces the voltage feedback and hence damping factor of the power amplifier 10 to values below 0.1. It is important to note that the resonance capacitor 74 has a low value, for example, 0.0068 $\mu$f across the pot 72. The function of the resonance capacitor 74 is to increase the damping factor value with increasing frequency. At low frequency the capacitor 74 has little effect. However, as the frequency increases the resonance capacitor 74 provides a current path around resonance pot 72 so as to reduce its effective impedance. Its value is chosen so that its impedance value will effectively short out the pot 72 at mid band frequencies, e.g. above 400 Hz. The resonance circuit 60 therefore causes reduction in the damping factor at very low frequencies below the mid range and thereby boosts low frequency power to the load 36 at or near the resonance frequency of the speaker 46 and its enclosure 48. This will boost the sound pressure level of the speaker in the low frequency range. The control is called resonance because it enhances the resonant sound of the associated loud speaker and its enclosure.

The resonance control 60 of the invention does not interfere the presence control 50. The two circuits in combination then have selected frequency ranges of operation which are independent and do not compromise the effectiveness each other which is an important feature of the invention.

In a preferred embodiment, the nominal impedance of the load 36 is 4, 8 or 16 ohm at 400 Hz which are more or less standardized values for commercially available loud speakers. At high frequency above 400 Hz, the impedance may be as high as 30 ohms. Likewise at low frequency below 400 Hz, the resonance impedance of the speaker 46 and enclosure 48 may peak as high as 50 ohms or more.

Figure 3A:
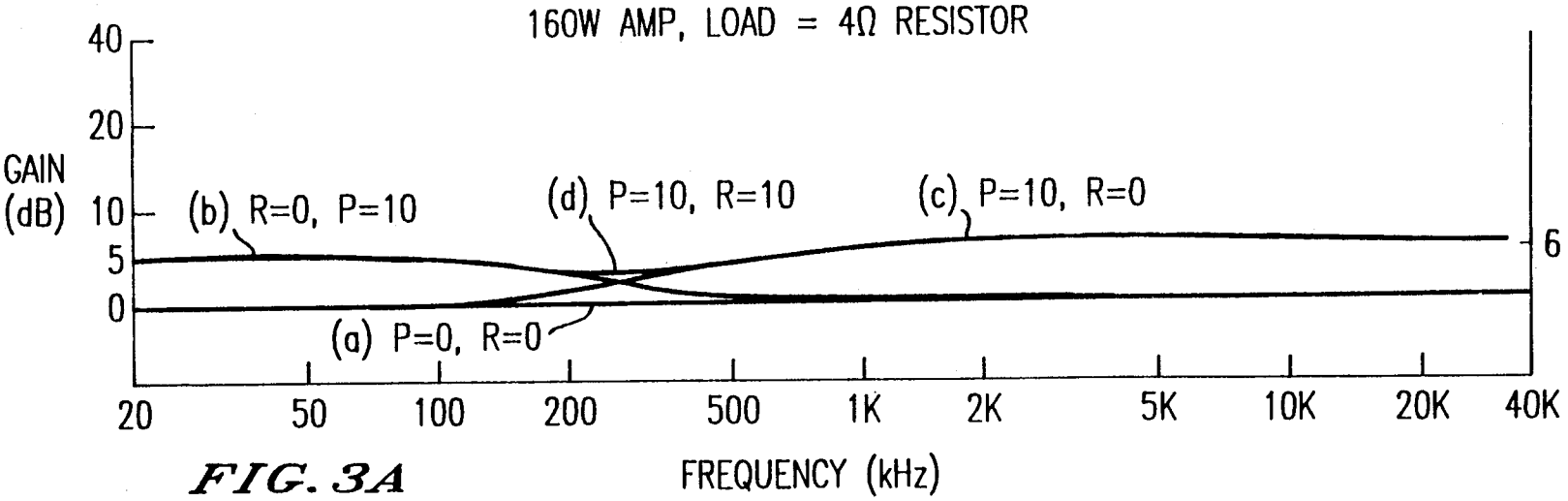
FIGS. 3A-3D illustrate various power curves of an amplifier having independently variable, frequency selective damping factor controls in accordance with the present invention over a range of audio frequencies.

FIG. 3A illustrates for the solid state amplifier 10 of FIG. 1 the effect of the presence control 50 and the resonance control 60 on output voltage with a purely resistance 4 ohm load. The curves (a–d) depict the presence and resonance controls 50 and 60 at various levels as shown. For example in curve (a) the presence and resonance controls are at zero and curve (a) is flat at about 0 db. In curve (b) resonance control 60 is at a high level (10) and presence is off (0). The curve (b) is boosted at the low end and trails off at about 400 Hz. Curve (c) shows the response for presence at (10) and resonance at (0). The curve shows a boost about 400 Hz into the high frequencies. Curve (d) shows the presence and resonance controls at (10). Both ends of the response are boosted. At the midrange the responses add. For a purely resistive load, the circuit does not have much effect.

Figure 3B:
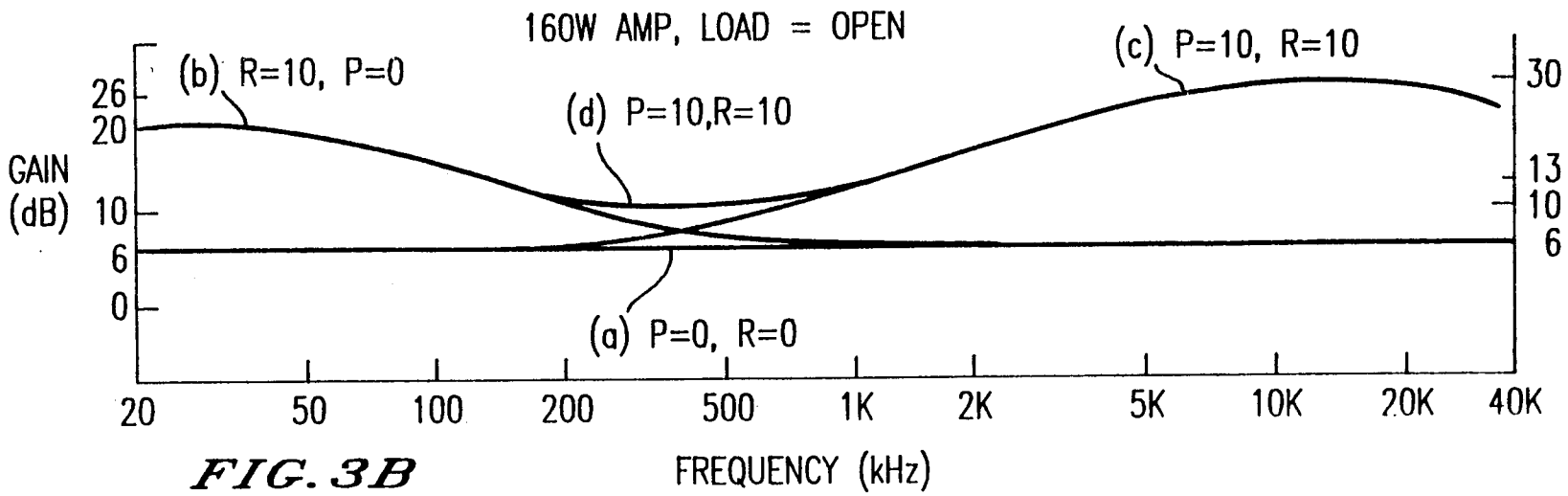

FIG. 3B shows dramatically what happens when the output is open circuit, i.e. when the load impedance 36 is high or effectively open circuit. The curves (a–d) in FIG. 3B show the response to the corresponding settings described above with respect to FIG. 3A. Note that there is a significant boost at the low and high ends which are each independent (curve(d)). At mid range the responses add when both controls are high. Thus, as the load impedance increases, damping factor may be adjusted to enhance the amplifier output.

Figure 3C:
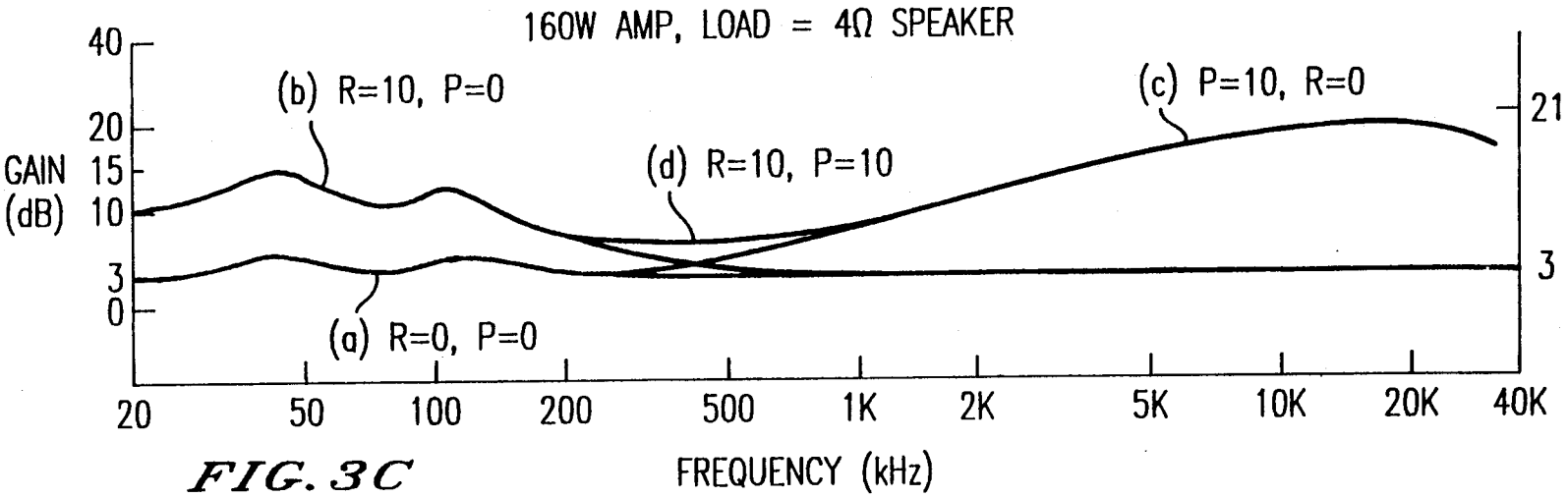

FIG. 3C shows the response of the circuit of FIG. 1 with a 4 ohm speaker as a load and for conditions corresponding to curves a–d. Note that the boost is significant at both frequency extremes. Multiple resonance peaks are shown at 45 and 135 Hz. The peaks represent the speaker resonance and the enclosure resonance respectively which are not matched. This is typical of a less expensive speaker system.

Figure 3D:
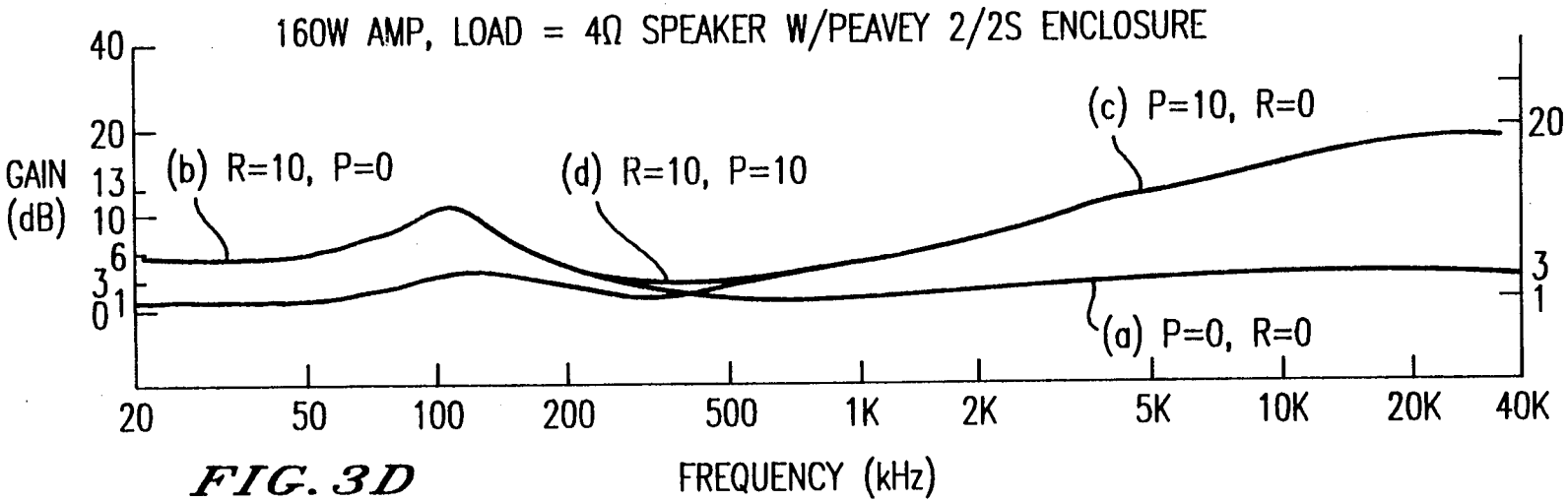

FIG. 3D illustrates the response for conditions corresponding to curves a–d for a speaker and enclosure with matched resonance characteristics at about 100 Hz. The curves for the speaker show a strong increase in response with frequency departures from the mid range of 400 Hz as the presence and resonance controls are set at full CW (10).

A comparison of FIGS. 3C and 3D shows that the speaker is a part of the control loop, that is, the speaker characteristic is an element in the circuit and is itself enhanced by selective manipulation of the controls in a way not previously attainable with simple passive components. Also, although speaker performance is improved in general, the response of the relatively inexpensive speakers is significantly improved so as to imitate more expensive systems. In addition, a solid state amplifier has been described which more realistically emulates a tube amplifier for added performance.

The relative values of the various resistors and capacitors are important to establish range of effectiveness of the damping factor controls of the present invention. In the exemplary embodiment of FIG. 1, the following values are employed.

| | |
|---|---|
| DC Feedback Resistor 26, 28 | 18K ohm |
| DC Capacitor 30 | 100 uf |
| AC Feedback Resistor 32 | 220K ohm |
| AC Feedback Capacitor 34 | 10 pf |
| Current Feedback Resistor 40 | 1K ohm |
| Sampling Resistor 38 | 0.1 ohm |
| Gain Resistor 44 | 3.9K |

-continued

| | |
|---|---|
| Resonance Feedback Resistor 70 | 10K ohm |
| Divider Resistor 56 | 10K ohm |
| Resonance Pot 72 | 100K |
| Resonance Capacitor 74 | 0.033 uf |
| Presence Pot 80 | 10K ohm |
| Presence Capacitor 82 | 0.1 uf |
| Input Resistor 20 | 33K |
| Input Capacitor 18 | 2.0 uf |

Figure 2:
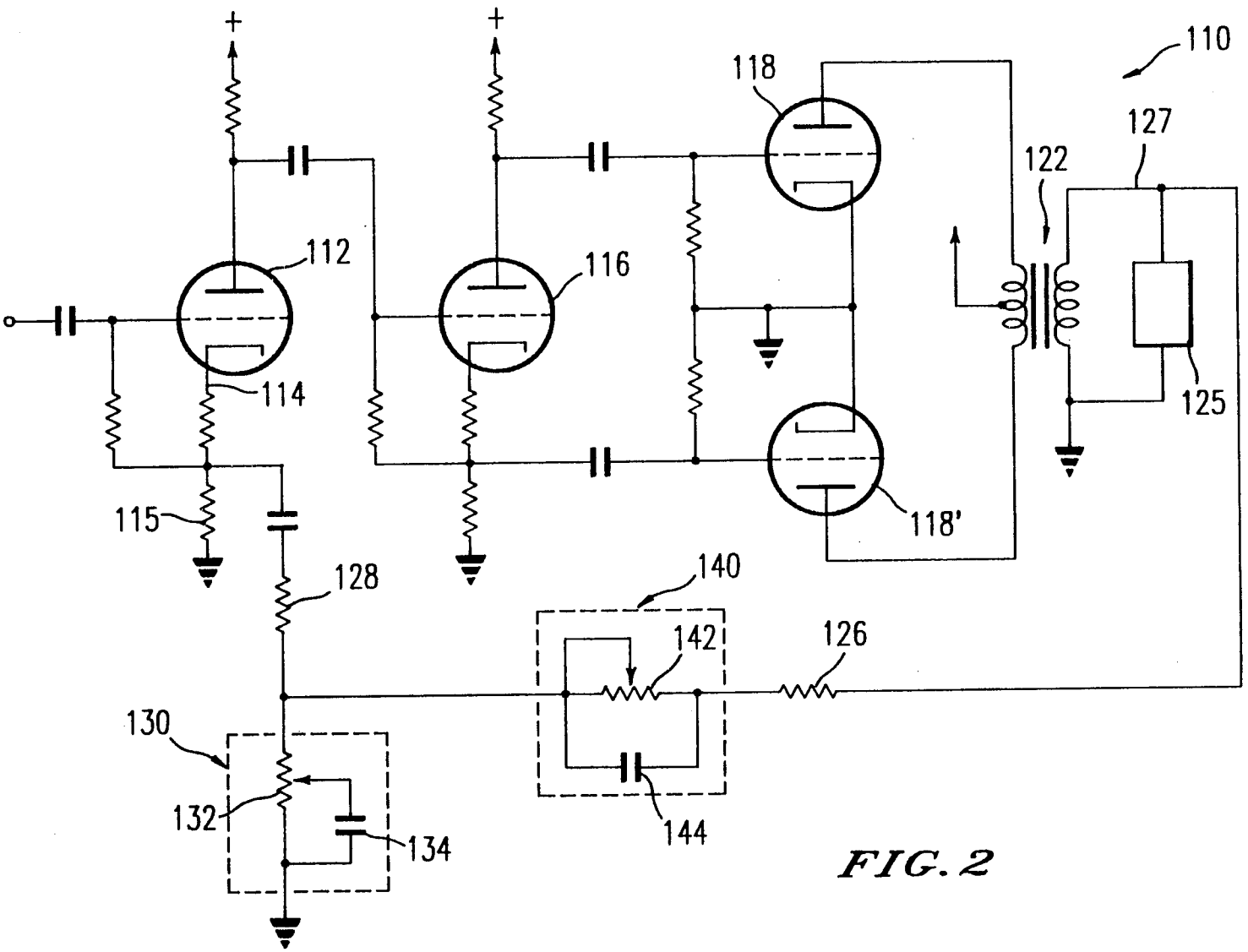
FIG. 2 is a schematic diagram illustrating damping factor controls in an audio amplifier employing electron tubes.

FIG. 2 illustrates an embodiment of the invention in a tube amplifier circuit 110 including input gain stage 112 with feedback to cathode 114 and cathode resistor 115. Phase inverter stage 116 drives output tubes 118–118' arranged in push/pull (class AB) configuration. The outputs of the tubes 118–118' are coupled to opposite sides of the transformer 122 feeding load 125. Overall feedback is supplied from the output 127 by resistor 126 divider resistor 128.

Presence control 130 including presence pot 132 and presence capacitor 134 in parallel is connected between the ground and the cathode 114 via divider resistor 128. Resonance control 140 is in series with the resistor 126 and includes resonance pot 142 and resonance capacitor 144 in parallel. The presence control 130 and the resonance control 140 are commonly coupled to the divider resistor 128 as shown.

The operation of the presence control 130 and resonance control 140 similar to the arrangement of FIG. 1. The overall system is simplified, however, because the tube amplifier 110 does not require a current feedback circuit resulting from minimum feedback requirement of solid state amplifiers.

Typical components by use for the circuit of FIG. 2 are as follows:

| | |
|---|---|
| Cathode resistor 115 | 18K ohm |
| Divider resistor 128 | 100K ohm |
| Resonance Pot 132 | 10K |
| Presence Capacitor 134 | 0.033 uf |
| Resonance Pot 142 | 1M ohm |
| Resonance Capacitor 144 | .0068 uf |
| Feedback Resistor 126 | 68K |

While there have been described what at present are considered to be preferred embodiments of the invention, it will be readily apparent to those skilled in the art that various changes and modifications may be made therein without departing from the invention. Accordingly, it is intended in the claims which follow to cover all such changes and modifications which fall within the true spirit and scope of the invention.

What is claimed is:

1. A power amplifier having a frequency selective variable damping factor, said amplifier having an input, an output and a feedback circuit coupled therebetween, the amplifier for driving a load in the feedback circuit having an impedance which varies with frequency between a high frequency cut-off and a low frequency resonance about a selected frequency comprising:

current feedback means in the feedback circuit;

first variable impedance means in the feedback circuit to ground for varying overall feedback to the amplifier input as the frequency increases above the selected frequency; and second variable impedance means in the feedback circuit between the input and the output for varying overall feedback to the amplifier input as the frequency decreases below the selected frequency, said first and second variable impedance means being independently operative with respect to each other to selectively reduce feedback delivered to the load in said feedback circuit in accordance with its respective impedance and said current feedback means being operative to selectively increase power delivered to the load with changing frequency above and below said selected frequency at the load resonance and the high frequency cut-off.

2. The power amplifier of claim 1 further including output feedback means coupled between the input and output circuit.

3. The power amplifier of claim 1 further including load feedback means coupled between the load and the input said load feedback means decreasing with load impedance.

4. The power amplifier of claim 1 wherein the amplifier is an audio amplifier and the load is a load speaker.

5. The power amplifier of claim 1 wherein the first variable impedance means varies response of said amplifier at high frequency and the second variable impedance varies response of said amplifier at low frequency.

6. The power amplifier of claim 1 wherein the amplifier is an audio amplifier for a guitar.

7. The power amplifier of claim 4 wherein the speaker has a characteristic frequency responsive impedance and the first and second variable impedance means are selectably variable to enhance the sound emitted by the speaker.

8. The power amplifier of claim 1 wherein the load has a nominal impedance at about 400 Hz, the impedance of the load increases from said nominal impedance above 400 Hz to about 20,000 Hz and from below 400 Hz to about 20Hz.

9. The power amplifier of claim 1 wherein the amplifier operates over a range of frequencies and further includes impedance means in parallel with each of the first and second variable impedance means for establishing a maximum gain factor for the amplifier over said range of frequencies.

10. The power amplifier of claim 1 further including voltage feedback means between the input and output, said first variable impedance means for coupling the voltage feedback means to ground and the second variable impedance means for coupling the output to the input.

11. The power amplifier of claim 1 wherein the amplifier is a solid state device.

12. A solid state audio power amplifier having an input, an output and a frequency selective damping factor, said amplifier for driving at its output a load in the form of a sound producing loud speaker exhibiting a frequency variable impedance characteristic over a range of audio frequencies comprising:

voltage limit feedback means coupled between the input and the output for establishing a minimum voltage feedback characteristic over said range of frequencies;

load current feedback means coupled between the load and the input for establishing a feedback characteristic representative of the load;

presence feedback means coupled in parallel with the voltage feedback means for reducing voltage feedback with increasing frequency above the selected level whereby the damping factor of the amplifier is reduced; and resonance feedback means coupled in series with the voltage feedback means for reducing voltage feedback with decreasing frequency below a selected level whereby the damping factor of the amplifier is reduced, said amplifier being responsive to the reduced damping factor for selectively adding power to the load for enhancing the sound produced by the loud speaker at frequencies above and below the selected frequency.

13. An audio power amplifier having an input, an output, and a feedback circuit between the input and the output said amplifier for driving a frequency dependent variable impedance loud speaker load at its output, said amplifier exhibiting a load dependent damping factor variable with frequency comprising:

presence feedback means coupled in parallel with the feedback circuit for reducing feedback with increasing frequency above a selected level whereby the damping factor of the amplifier is reduced when the impedance of the load decreases with increasing frequency; and resonance feedback means coupled in series with the feedback circuit for reducing feedback with decreasing frequency below the selected level whereby the damping factor of the amplifier is reduced when the impedance of the load decreases with decreasing frequency, said amplifier being responsive to the reduced damping factor for selectively adding power to the load for enhancing the sound produced by the loud speaker at frequencies above and below the selected frequency said presence and resonance feedback means being independently variable with respect to each other.

14. An audio power amplifier having an input, an output and at least one feedback path for establishing a feedback level, said amplifier for driving a load in the form of a loud speaker having a nominal impedance and a characteristic increasingly variable impedance with frequency departures from a mid range value, said amplifier exhibiting a damping factor characteristic dependent on the feedback level comprising:

presence control means coupled to the feedback path for lowering feedback with increasing frequency from the mid range value and decreasing damping factor of the amplifier above the said mid range as the load impedance increases; and resonance control means coupled in the feedback path for lowering feedback with decreasing frequency from the mid range value, and decreasing the damping factor of the amplifier below said mid range as the load impedance decreases, the presence control means and the resonance control means each being independently selectively variable for increasing power delivered to the load in accordance with the increasing characteristic speaker impedance forming a variable element in each of the presence and resonance control means.

15. An audio power amplifier having a frequency selective variable damping factor, said amplifier having an input, an output and a feedback circuit coupled therebetween, the amplifier for driving a loud speaker in the feedback circuit having an impedance which varies about a selected frequency upwardly to a resonance condition below the selected frequency and upwardly to a high-frequency roll-off above the selected frequency, said audio amplifier comprising:

first variable impedance means coupled to the feedback circuit for introducing an impedance in the feedback circuit operative to reduce feedback with increasing impedance above the selected frequency;

second variable impedance means coupled to the feedback circuit for introducing an impedance operative to reduce feedback with increasing impedance below the selected frequency; and a current feedback path coupled in the feedback circuit for connection to the loud speaker and the first and second variable impedance means for selectively reducing feedback at resonance and the high frequency roll-off in accordance with the increasing loud speaker impedance.

16. An audio amplifier having an input and output for driving a load in the form of a loud speaker having a low frequency characteristic impedance at loud speaker resonance and a high frequency characteristic impedance at roll-off comprising:

a voltage feedback circuit coupled below the output and the input for varying overall feedback between the input and the output; and a current feedback circuit coupled between the input and the output for connection to the load said current feedback circuit for establishing load responsive feedback which increases with increasing load impedance such that additional power is selectively delivered to the load at resonance and roll-off whereby the loud speaker produces an output sound with audible emphasis at resonance and roll-off.

* * * * *